US006031342A

United States Patent [19]

Ribarich et al.

[11] Patent Number: 6,031,342

[45] Date of Patent: Feb. 29, 2000

[54] UNIVERSAL INPUT WARM-START LINEAR BALLAST

[75] Inventors: Thomas J. Ribarich, Laguna Beach; John Parry, Hermosa Beach, both of Calif.

[73] Assignee: International Rectifier Corporation, El Segundo, Calif.

[21] Appl. No.: 09/022,476

[22] Filed: Feb. 12, 1998

Related U.S. Application Data

[60] Provisional application No. 60/037,925, Feb. 12, 1997, provisional application No. 60/037,922, Feb. 12, 1997, and provisional application No. 60/070,481, Jan. 5, 1998.

[51] Int. Cl.[7] ..... G05F 1/00

[52] U.S. Cl. ..... 315/291; 315/224; 315/209 R; 315/DIG. 7; 361/57

[58] Field of Search ..... 315/307, 308, 315/291, 209 R, 244, 247, 127, DIG. 4, DIG. 5, DIG. 7; 361/57, 18, 79, 93; 363/56, 98, 132

[56] References Cited

U.S. PATENT DOCUMENTS 4,210,846 7/1980 Capewell et al. ..... 315/121
4,907,116 3/1990 Aschwanden et al. ..... 361/18
5,410,221 4/1995 Mattas et al. ..... 315/307
5,545,955 8/1996 Wood ..... 315/224

*Primary Examiner*—Haissa Philogene
*Attorney, Agent, or Firm*—Ostrolenk, Faber, Gerb & Soffen, LLP

[57] ABSTRACT

An electronic ballast for a fluorescent lamp which includes a frequency sweep circuit for driving a ballast controller IC at different operating frequencies depending on the operating mode of the fluorescent lamp. The sweep circuit monitors the operating mode of the lamp (e.g., preheat, ignite, running, shutdown) and automatically generates an appropriate variable voltage offset for controlling the lamp. The offset is added to a constant voltage supplied to an input of the ballast controller IC, resulting in a corresponding change in the frequency output by the ballast controller IC (and thus the lamp power). The electronic ballast also includes fault protection logic which monitors signals from the lamp resonant circuit and shuts down the ballast in the event of a fault condition. The fault protection logic also resets the frequency sweep circuit so that the lamp can restart automatically when the fault is corrected.

11 Claims, 8 Drawing Sheets

TIMING DIAGRAMS FOR DIFFERENT $V_{OFFSET}$ VOLTAGES

UNIVERSAL INPUT WARM-START LINEAR BALLAST

This application claims the benefit of U.S. Provisional application Ser. Nos. 60/037,925 and 60/037,922, both filed on Feb. 12, 1997, and U.S. Provisional application Ser. No. 60/070,481, filed on Jan. 5, 1998, the disclosures of which are incorporated herein by reference.

BACKGROUND OF THE INVENTION

1. Field of the Invention

The present invention relates to an electronic ballast powering a fluorescent lamp system, and more specifically to an electronic ballast with circuitry for automatically varying the power supplied to a fluorescent lamp system in accordance with varying operating conditions.

2. Description of the Related Art

Electronic ballasts for gas discharge circuits have come into widespread use because of the availability of power MOSFET transistors and insulated gate bipolar transistors ("IGBTs"), which have replaced previously used power bipolar switching devices. Monolithic gate driver circuits, such as the IR2155 sold by International Rectifier Corporation and described in U.S. Pat. No. 5,545,955, the disclosure of which is herein incorporated by reference, have been devised for driving the power MOSFETs or IGBTs in electronic ballasts. The IR2155 gate driver IC offers significant advantages over prior circuits in that it is packaged in a conventional DIP or SOIC package and contains internal level shifting circuitry, undervoltage lockout circuitry, dead-time delay circuitry, and additional logic circuitry and inputs so that the driver can self-oscillate at a frequency determined by external resistors $R_T$ and $C_T$.

Unfortunately, however, for an electronic ballast with a resonant type output stage (FIG. 1), the frequency of operation of the lamp cannot remain constant. Rather, it is necessary to preheat the lamp at a frequency higher than the resonant frequency, lower the frequency substantially to strike the lamp and, upon lamp ignition, ramp up again to a running frequency. This allows the lamp filaments to be adequately pre-heated before ignition, and allows the voltage across the lamps to gradually increase at a given rate until the lamp ignites and the circuit becomes a low-Q circuit with the lamp running at a given power. Furthermore, if the lamp fails to strike, the gradual increase in lamp voltage and circuit currents allows the half-bridge to be shut off at some predetermined maximum, therefore, avoiding any high currents or voltages which may exceed the maximum ratings of the half-bridge switches, the resonant inductor or resonant capacitor.

It would therefore be desirable to provide a circuit for an electronic ballast which can vary the frequency output by the ballast controller integrated circuit automatically in accordance with the mode of operation (e.g., preheat, ignition, normal operation, shutdown).

In addition to the foregoing, it would be desirable for the electronic ballast circuitry to sense and automatically react to certain fault conditions.

For example, the ballast should first sense if a lamp is present before starting. Additionally, if the lamp is removed or if any of the lamp cathodes should break during running, it is essential that the ballast shutdown (i.e., turn-off the power transistors) to prevent damage to the ballast. If the damaged lamp is then replaced with a functional one, it is desirable that the ballast automatically re-start without the need to manually reset the main voltage at the input.

Prior solutions to sensing if a lamp is present before starting the ballast include a pull-up resistor 204 disposed between the lower lamp cathode and the DC bus voltage (see FIG. 1). If the lamp 202 is removed, then the sensing voltage (i.e., the lamp detection signal) fed back to the driver circuit over line 203 is no longer held 'low' by the low-ohmic lamp cathode and is pulled 'high' by the pull-up resistor 204. This signal can then be used by a shutdown circuit in the ballast to turn off MOSFETs/IGBTs 206 and 208 and therefore, prevent the ballast from being damaged. If the lamp 202 is re-inserted, the signal is pulled 'low' by the cathode resistance and the shutdown circuit frees MOSFETs/IGBTs 206 and 208, and the ballast starts again. This method, however, only senses if the lower cathode breaks. If the upper cathode breaks, the ballast will not shutdown and MOSFETs/IGBTs 206 and 208 eventually will thermally destruct.

In summary, a need exists for an electronic ballast that automatically varies the frequency of the half-bridge circuit depending upon the operating mode, and which furthermore senses a variety of potentially catastrophic conditions, and shuts down upon the occurrence of such conditions.

SUMMARY OF THE INVENTION

The present invention is an electronic ballast for a fluorescent lamp which advantageously includes a frequency sweep circuit for driving a ballast controller IC at different operating frequencies depending on the operating mode of the fluorescent lamp. The sweep circuit monitors the operating mode of the lamp and automatically generates an appropriate variable voltage offset for controlling the lamp. The offset is added to a constant voltage supplied to an input of the ballast controller IC, resulting in a corresponding change in the frequency output by the ballast controller IC (and thus the lamp power).

The electronic ballast of the present invention also includes fault protection logic which monitors signals from the lamp resonant circuit and shuts down the ballast in the event of a fault condition. The fault protection logic also resets the frequency sweep circuit so that the lamp can restart automatically when the fault is corrected.

Other features and advantages of the present invention will become apparent from the following description of the invention which refers to the accompanying drawings.

DETAILED DESCRIPTION OF THE PREFERRED EMBODIMENTS

Figure 1:
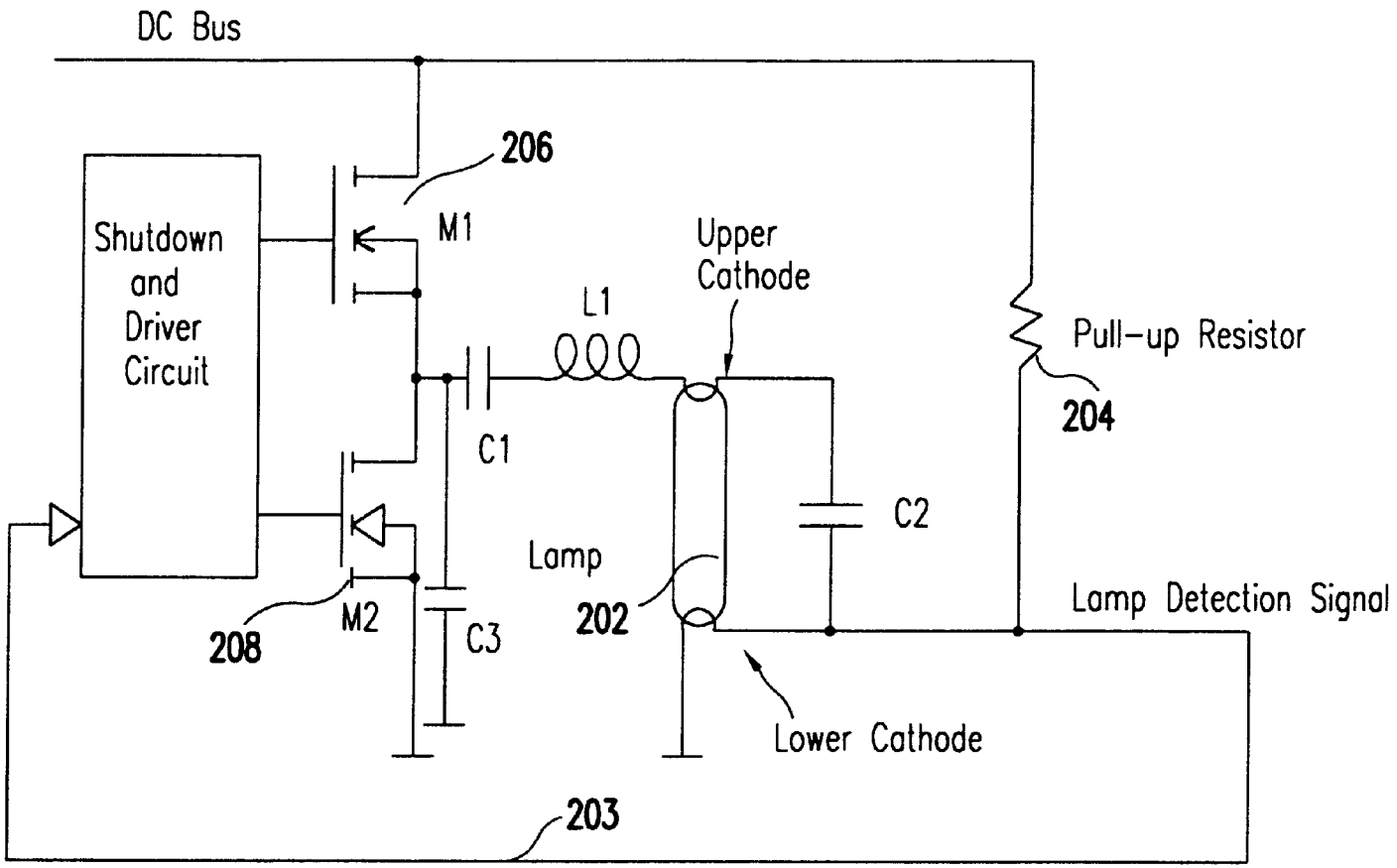
FIG. 1 PRIOR ART
FIG. 1 is a schematic diagram of a prior art electronic ballast and lamp resonant circuit.
Figure 2:
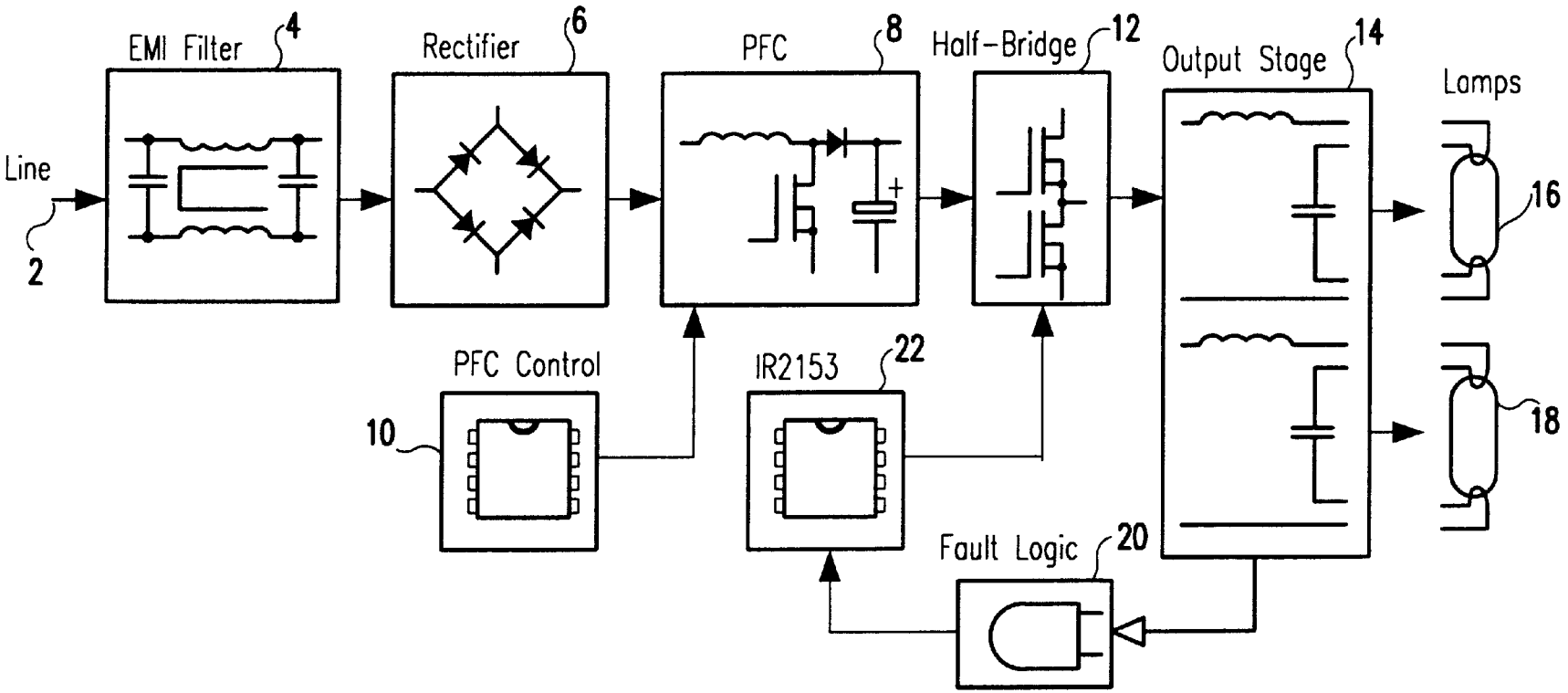
FIG. 2 is a block diagram of the electronic ballast circuit of the present invention.

Referring to FIG. 2, a simplified block diagram of a universal input warm-start linear ballast according to the present invention is shown. An AC line voltage 2, passed through an EMI filter 4, is converted to DC voltage by a rectifier 6. The rectified voltage is provided to a power factor control (PFC) circuit 8, operated by a power factor control IC 10. The PFC controlled power is supplied through a half-bridge 12 to an output stage 14 which powers lamps 16, 18.

A feedback loop provides fault protection through a fault logic circuit 20 that connects from the output stage 14 to a ballast controller 22. The fault logic circuit senses the current in output stage 14 and, if a fault is detected, shuts down the ballast controller IC 22. Additionally, although not shown in FIG. 2, sweep circuitry is provided for automatically varying ballast controller IC 22 to vary the operating frequency in accordance with varying operating conditions of lamps 16 and 18.

Figure 3A:
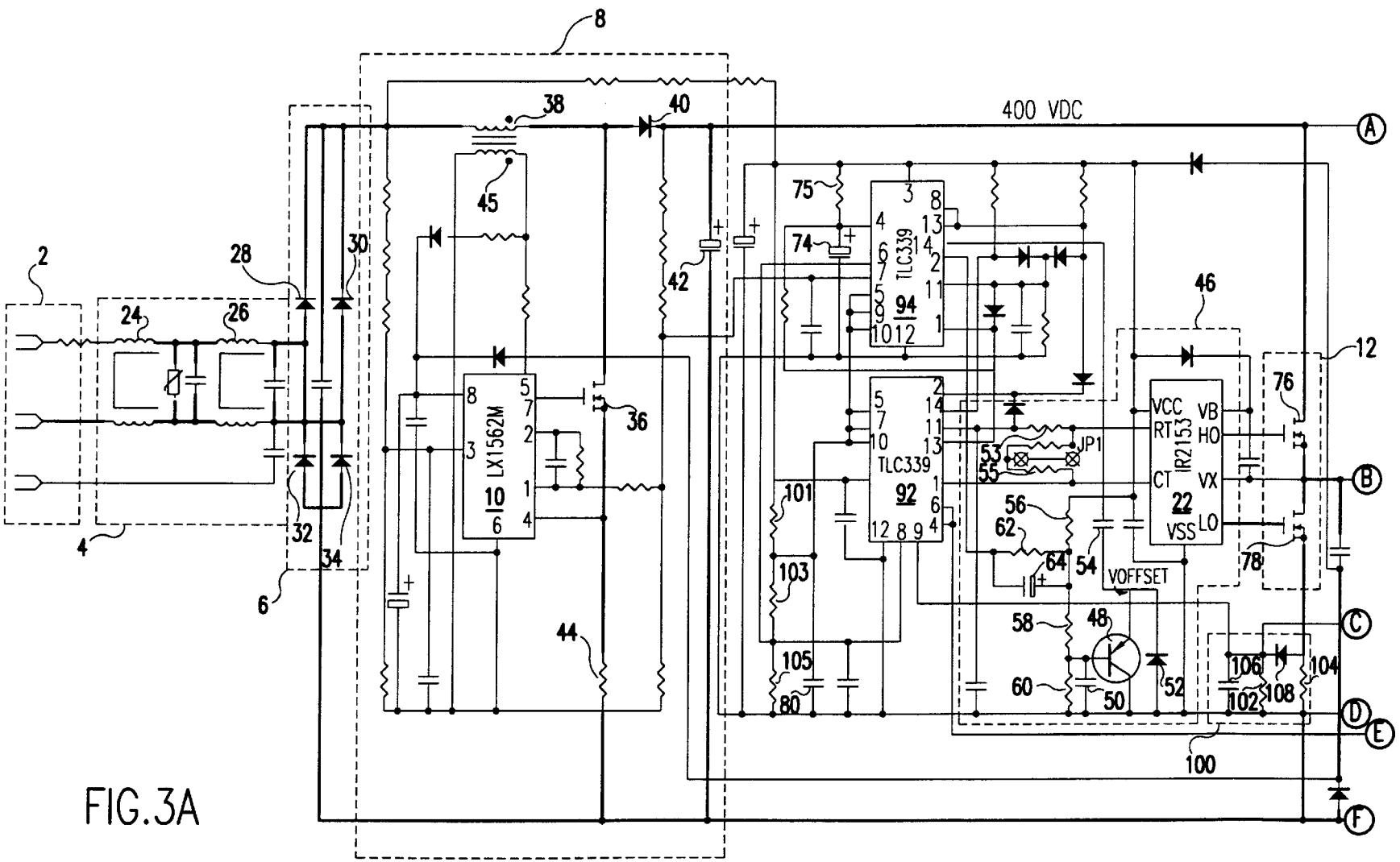
FIGS. 3A and 3B depict a detailed circuit schematic of the electronic fluorescent light ballast of the present invention.
Figure 3B:
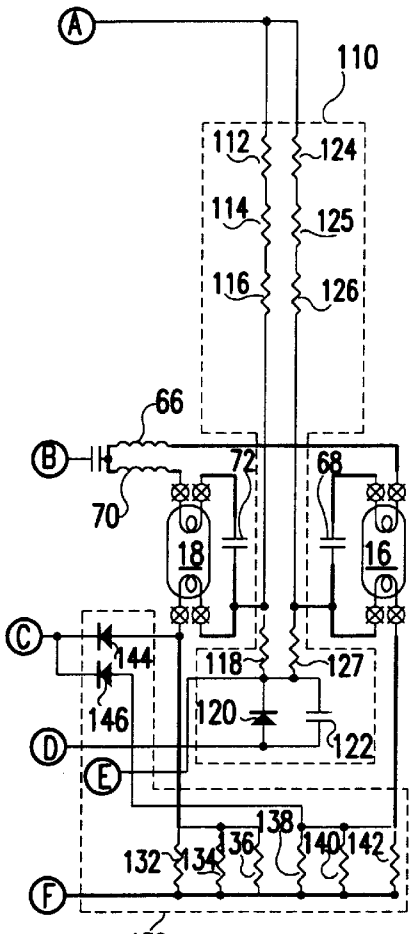

Referring to FIGS. 3A and 3B, a detailed circuit schematic of an electronic ballast according to the present invention is shown. Each of the sections of the electronic ballast of the present invention is described in detail below:

EMI Filter and Rectifier

Line voltage 2 is supplied to EMI filter 4, provided by paired inductors 24 and 26. Filtered power is supplied to rectifier 6, which is formed of diodes 28, 30, 32, and 34.

Power Factor Control

Power factor control section 8 includes the LinFinity LX1562 Power Factor Controller IC 10, MOSFET 36, inductor (L3) 38, diode 40, capacitor 42, and additional biasing, sensing and compensation components. The charging current of inductor 38 is sensed in the source of MOSFET 36 (resistor 44). The zero-crossing of the inductor current, as inductor 38 charges the DC bus capacitor 42, is sensed by a secondary winding 45 on inductor 38.

The result is critically continuous, free-running frequency operation where:

$$L3 = \frac{V_{in}^2(V_{out} - \sqrt{2}\,V_{in})\eta}{2P_{out}V_{out}f_s\pi} \quad (1)$$

$$I_{L_p} = \frac{P_{out}2\sqrt{2}}{V_{in\ \min}\eta} \quad (2)$$

where, $\eta$=efficiency $V_{in}$=nominal AC input voltage $V_{out}$=DC bus voltage $P_{out}$=lamp power $f_s$=switching frequency The value of the boost inductor (L3) 38 can be calculated and the core should be dimensioned to handle the associated inductor peak currents for the desired range of AC input voltage.

Ballast Control

Ballast control section 46 provides the important function of frequency sweep; i.e., varying the voltage supplied to the ballast controller IC 22 to vary the operating frequency of half-bridge circuit 12 in accordance with the mode of operation of the lamp. Ballast control section 46 includes a transistor 48, a capacitor 50, a diode 52, and a capacitor 54 which determine the operating frequency of a voltage controlled oscillator (VCO). The VCO is programmed to different operating frequencies with a voltage divider formed of resistors 56, 58, 60, 62, and capacitor 64, all part of ballast control section 46.

The VCO drives the lamp resonant output stage 14 (which, for the two-lamp embodiment shown, is formed of inductor 66 and capacitor 68, and inductor 70 and capacitor 72) at the appropriate frequency in accordance with the operating mode (i.e., preheat, ignition, running, or shutdown). This is carried out by automatically setting (in accordance with the operating mode) the voltage at the base of transistor 48, which in turn varies the voltage at the CT input of the ballast controller IC 22 and, accordingly, varies the operating frequency of the lamp resonant circuit and thus the power delivered to the lamps.

Figure 4:
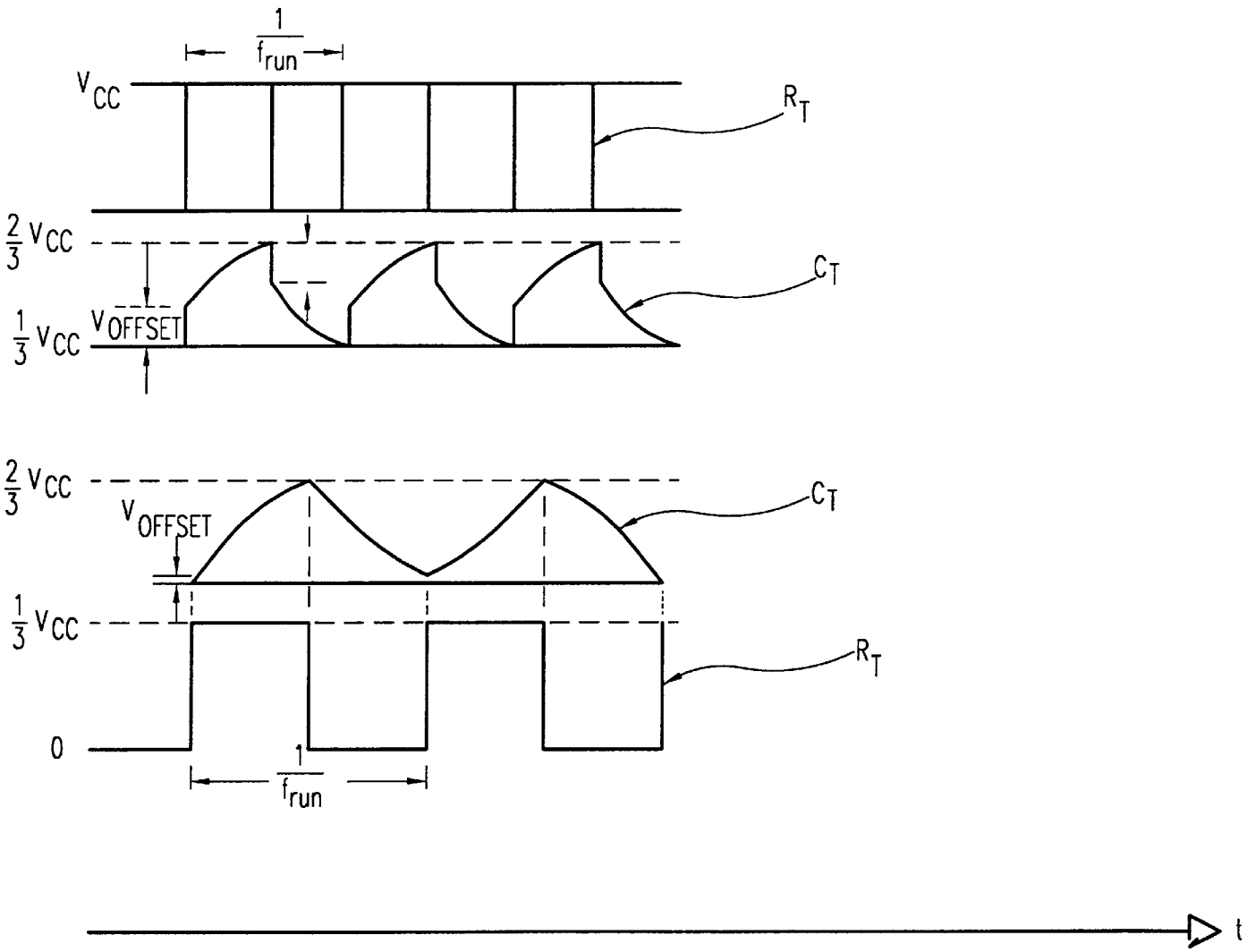
FIG. 4 is a timing diagram showing the change in oscillating frequency for different $V_{OFFSET}$ voltages.

More specifically, ballast control section 46 operates as follows:

When a D.C. bus voltage is established, the half-bridge driver 12 begins to oscillate (after VCC delivered to ballast controller IC 22 exceeds an arbitrary turn-on threshold). This initial frequency of oscillation is determined by resistor ($R_T$) 55, capacitor ($C_T$) 54, and the offset voltage at node $V_{OFFSET}$. By adjusting $V_{OFFSET}$, the voltage at the CT input of ballast controller IC 22 is adjusted, and thus the frequency of turn-on and turn-off of the half-bridge switches, as controlled by HO and LO output signals from ballast controller IC 22, will change. As can be seen in FIG. 4, an increase in $V_{OFFSET}$ will produce an increase in frequency and a decrease in $V_{OFFSET}$ will produce a decrease in frequency.

The relationship of $V_{OFFSET}$ to frequency is calculated to be:

$$f_{Run} = \frac{1}{-\ln\left[\frac{VCC}{2VCC - 3V_{OFFSET}}\right]2R_TC_T}$$

and is not linear.

The additional components of ballast control section 46, namely diode 52, transistor 48, capacitor 50, resistor 60, resistor 58, resistor 56, resistor 62 and capacitor 64 are used to achieve the sweep from an initial high-frequency (during preheat) to the lower running frequency.

The operation of ballast control section 46 for various operating modes is described below in the following sections. The ballast control logic is best understood by reference to the schematic of FIG. 5. Components common to the overall schematic of FIG. 3 and the detailed schematic of FIG. 6 have the same reference numerals. IC's 92 and 94 of FIG. 3A are shown as separate logic components in FIG. 5, designated as 92A, 92B, 92C, and 92D, and 94A, 94B, 94C, and 94D, respectively. FIG. 6 is a timing diagram for the ballast control logic showing preheat, ignition, normal running operation and shutdown.

1. Preheat:

During preheat, the half-bridge operating frequency is fixed at a set value for a time duration determined by the time required to charge capacitor 74 to a threshold voltage. During this period of time, the lamp filaments heat to their emission temperature before the lamp ignites. This increases the life of the lamp and decreases ignition voltages and currents, yielding reduced ratings for maximum voltage and current of both lamp resonant output stage 14, and half-bridge power MOSFETs/IGBTs 76, 78.

More specifically, during preheat, the fixed frequency of operation is determined by the voltage at the base of transistor 48, which is set by a voltage divider formed of resistors 56, 58 and 60. This predetermined voltage at the base of transistor 48 drives $V_{OFFSET}$ to an initial voltage corresponding to an initial starting frequency. This initial voltage is given by the $V_{EC}$ of transistor 48 plus the forward voltage drop across diode 52.

2. Ignition:

During preheat, as mentioned above, capacitor 74 charges up through resistor 75. When the voltage on capacitor 74, which is connected to the input pin 4 of comparator IC 94, exceeds a threshold voltage (i.e., the voltage on capacitor 80 determined by a voltage divider consisting of resistors 101, 103 and 105), comparator 94A (see FIG. 5) outputs a logic low at pin 2 of comparator IC 4. This logic low momentarily pulls down the voltage at the base of transistor 48, resulting in a lower $V_{OFFSET}$, therefore sweeping the frequency lower towards the resonance frequency for ignition (see FIG. 6).

The ignition frequency is the minimum ballast operating frequency defined as $$f_{ignition} = \frac{1}{1.13\,(C54)(R55+75)} \tag{3}$$

where C54 is the value of capacitor ($C_T$) 54, and R55 is the value of resistor ($R_T$) 55.

3. Running:

During the ignition ramp, capacitor 64 charges at a much lower rate than capacitor 50. As a result, the voltage at the base of transistor 48 increases after ignition to a running value determined by the parallel connected resistor 62. Accordingly, resistor 62 sets the final running frequency where the lamp is driven to the manufacturer's recommended lamp power rating. The running frequency of the lamp resonant output stage for selected component values is defined as $$f_{run} = \frac{1}{2\pi}\sqrt{\frac{1}{LC} - 2\left(\frac{P_{Lamp}}{CV_{Lamp^2}}\right)^2 + \sqrt{\left(\left[\frac{1}{LC} - 2\left(\frac{P_{Lamp}}{CV_{Lamp}^2}\right)^2\right]\right)^2 - 41 - \frac{\left(\frac{2V_{DCbus}}{V_{Lamp}\pi}\right)^2}{L^2C^2}}} \tag{4}$$

where,

L=Lamp resonant circuit inductor [Henries]

C=Lamp resonant circuit capacitor [Farads]

$P_{lamp}$=Lamp running power [Watts]

$V_{lamp}$=Lamp running voltage amplitude [Volts]

Fault Protection

The present invention includes fault protection circuitry to shutdown the ballast in the event of a detected fault condition. The circuitry includes two quad comparator ICs 92 and 94 (comparator IC 94 is also used for frequency sweep as discussed above). The comparator IC's 92 and 94 respond to sensed signals indicating the occurrence of certain operating conditions, such as lamp resonance current fault, lamp removal, and over-current, as follows:

1. Resonance current:

The fault detection circuitry includes a lamp resonance current detection circuit 100 formed of resistors 102 and 104, capacitor 106, and diode 108.

Figure 5:
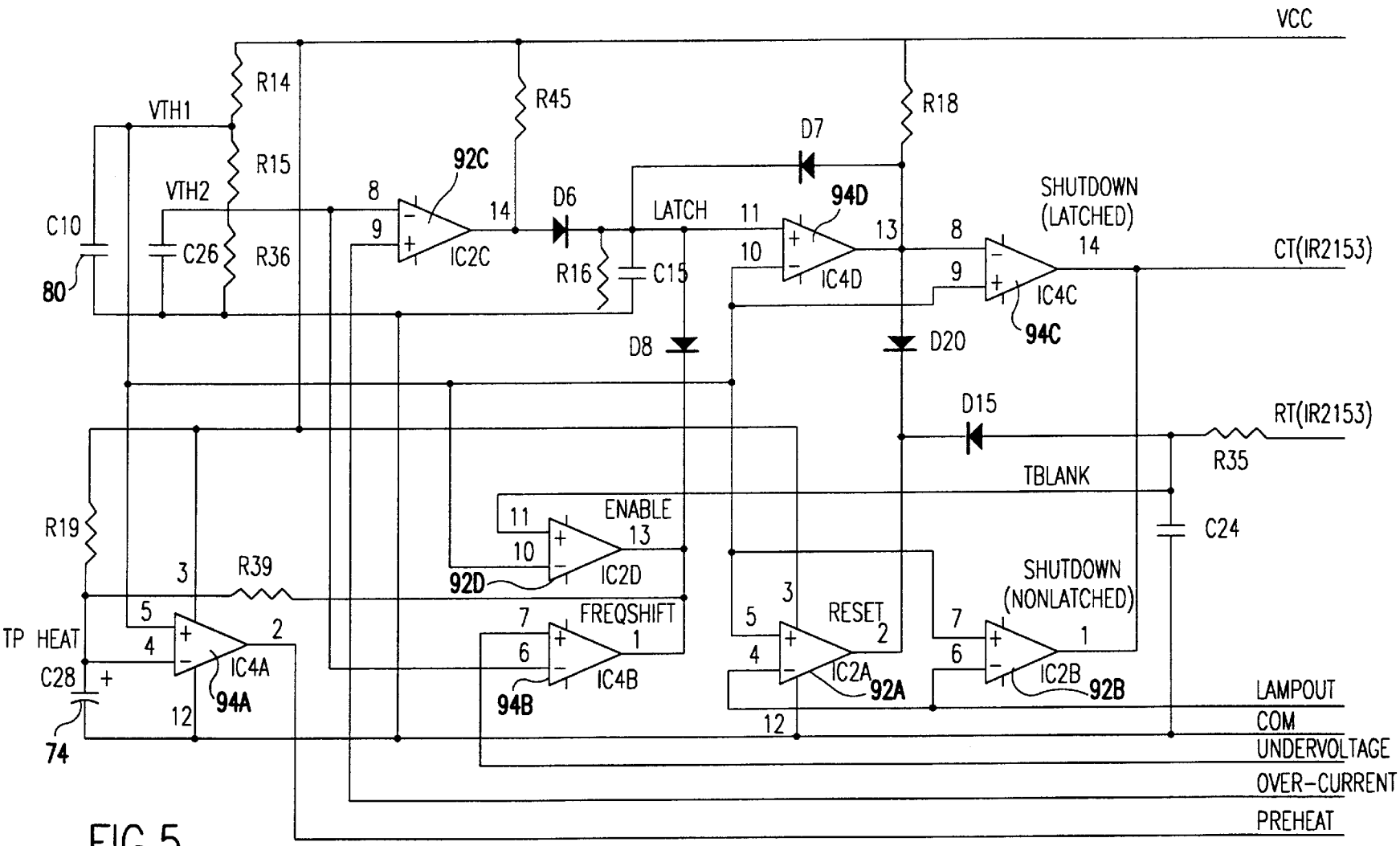
FIG. 5 is a detailed circuit schematic of the fault protection logic circuitry of the present invention.
Figure 6:
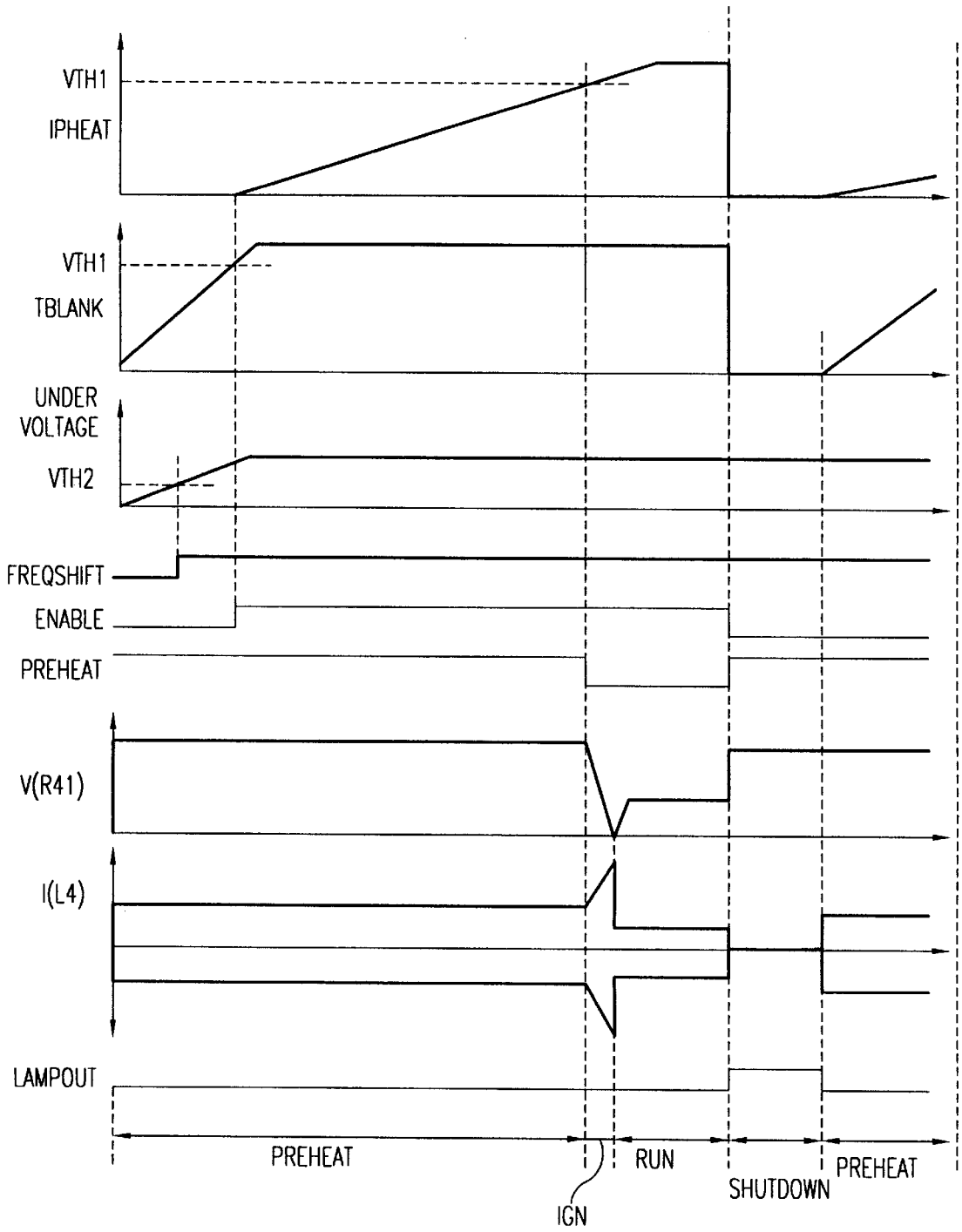
FIG. 6 is a timing diagram corresponding to the logic circuitry of FIG. 5, and showing the voltage and current waveforms for the operating modes of preheat, ignition, normal running operation, and shutdown.

Current detection circuit 100 rectifies (via diode 108) and integrates (via the low pass filter formed by the parallel combination of resistor 102 and capacitor 106) the voltage developed across resistor 104 which is connected between the source of the lower MOSFET/IGBT 78 of the half-bridge and ground (corresponding to the lamp resonant current), and compares that rectified and integrated voltage against a fixed threshold voltage (via comparator 92C—see FIG. 5).

Figure 7:
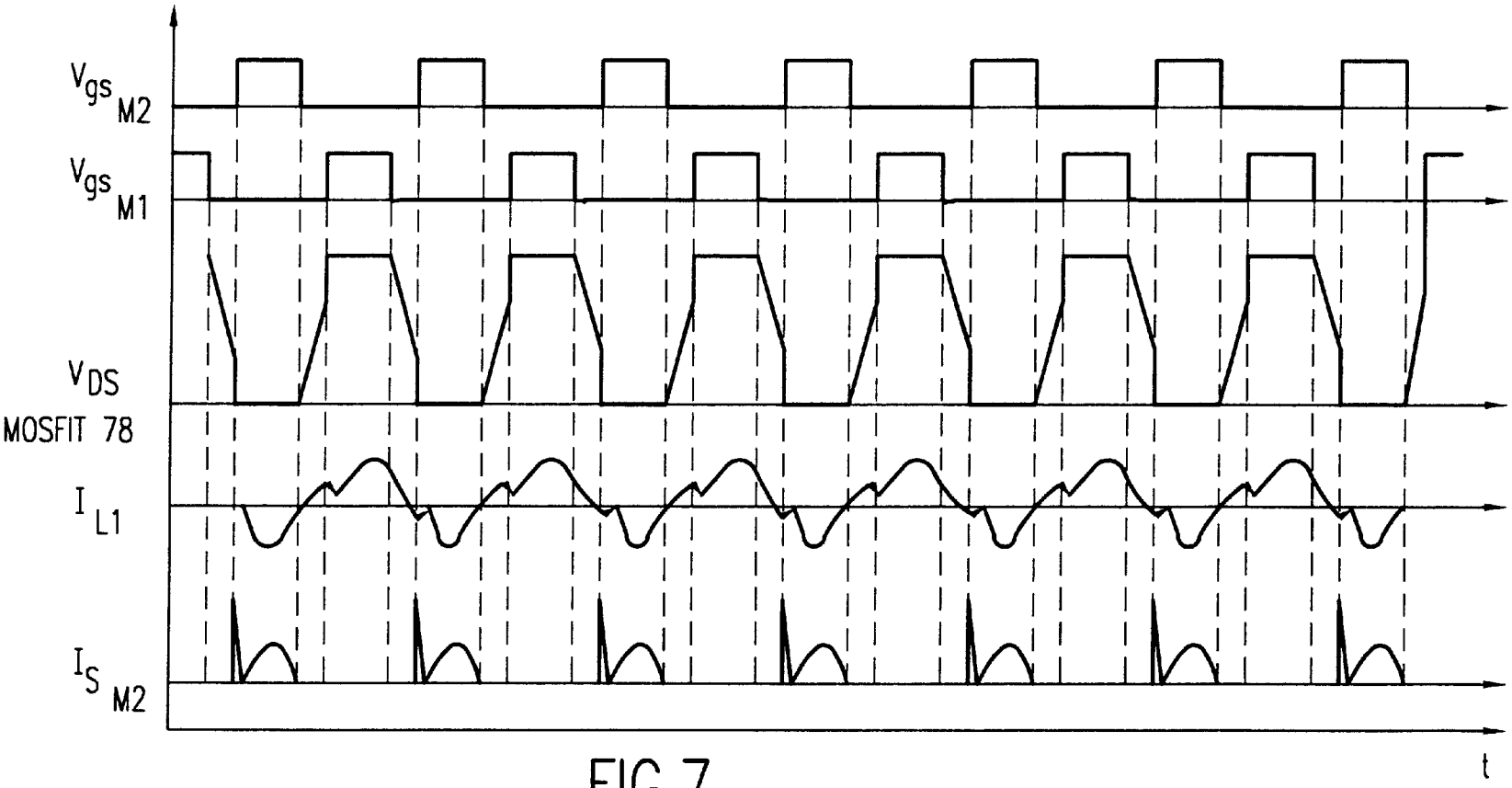
FIG. 7 is a timing diagram illustrating non-zero voltage switching of the half-bridge detected by the sensing circuit according to the present invention.

Should the amplitude and duration of the current develop a voltage which exceeds the threshold TH2, such as in the event of over-current due to a non-strike condition of the lamp or non-zero voltage switching of the half-bridge due to an open circuit or broken lamp cathodes, the comparator logic of the present invention latches the CT pin of the IR2153 IC 22 below the internal shutdown threshold (⅙ Vcc) and the ballast turns off. See timing diagram FIG. 7.

Blanking circuitry to delay enablement of the sensing circuitry during lamp start-up is provided to prevent detection of non-zero switching during start-up.

Referring to FIG. 5, the blanking circuitry includes capacitor C24 and comparator IC2D. At startup, capacitor C24 is initially discharged, such that the voltage on line TBLANK is lower than threshold VTH1, resulting in a low output from comparator IC2D. The low output of IC2D holds the line LATCH low via diode D8, thus disabling overcurrent shutdown during the startup blanking period, regardless of the output of the zero-voltage detection circuitry, i.e., regardless of the output of comparator 92C. Once capacitor C24 charges to the level of VTH1, the output of comparator IC2D goes high, and the blanking period ends.

2. Lamp Removal/Exchange:

The fault detection circuitry includes a pull-up lamp removal circuit 110 formed of resistors 112, 114, 116, and 118, diode 120, and capacitor 122.

In the event of a lamp removal/exchange, the voltage at pin 4 of comparator 92A and pin 6 of comparator 92B is pulled up to the Zener voltage of Zener diode 120. The resulting low logic output of comparator 92B shuts down the ballast, and, at the same time, the resulting low logic output of comparator 92A resets a shutdown latch within comparator IC 94. Thus, the circuitry acts to hold the CT pin 148 of the IR2153 IC 22 below the internal shutdown threshold in an unlatched state.

When a new lamp is reinserted, the ballast advantageously performs an auto restart without requiring recycling of the input line voltage. During a lamp removal, the frequency is also reset to the start frequency (by discharging capacitor 74—see FIG. 5) to avoid damage to the half-bridge switches 76, 78 due to below-resonance operation which can occur upon reinsertion of the lamp.

For a dual lamp ballast, a second pull-up network is added to the second lamp (resistors 124, 125, 126, and 127) and is 'OR-ed' together with the first lamp. If either lamp is removed during running, the ballast turns off.

3. Broken Upper Cathodes:

In the event of a broken upper cathode by either lamp during normal operation, non zero-voltage switching occurs at the half-bridge and will be detected by the over-current detection circuit 100 at the source of the lower MOSFET of the half-bridge. The ballast will latch both half-bridge MOSFETS off.

4. DC Bus Undervoltage:

Should the DC bus decrease below a fixed threshold voltage during an undervoltage condition of the line voltage, the frequency is shifted back up to the start frequency to fulfill zero-voltage switching of the half-bridge and the latch is disabled. This prevents latch-up during a fast cycling of the line voltage or a brown out.

5. Over-temperature:

The current fault detection circuitry 100 also uses the inherent temperature coefficient of diode 108 (−2 mV/° C.) to provide sensing of an over-temperature condition. Comparator IC 92 detects the increase in voltage across capacitor 106 as the ambient temperature inside the ballast housing increases, and shuts down the ballast in the event of an over-temperature condition.

6. Non-strike:

Lamp-strike failure circuitry 130 for the two lamps shown in FIG. 3B includes resistors 132, 134, and 136, connected to diode 144, and resistors 138, 140, and 142, connected to diode 146, respectively. An overcurrent condition is sensed at IC 92 and shutdown occurs, as described above with respect to similar the overcurrent faults, and automatic restart ensues.

Trimming

The final ballast running input power during can vary due to tolerances in L (inductors 66, 70), C (capacitors 68, 72), VBUS, and manufacturing variances of the lamp. Trimming is therefore provided in the preferred embodiment of the invention. Specifically, an insulated jumper wire (JP1) is connected across resistor 53 in this regard.

If the final run frequency exceeds the nominal specified run frequency by 4% (39 kHz), the input power will be too low, and the ballast may not ignite the lamp and/or deactivate in the event of a non-strike condition. This is because resistor 55 ($R_T$) programs the minimum operating frequency which corresponds to the ignition frequency. If this frequency is too high, the resulting lamp voltage may be too low to ignite the lamp and the resulting current may be too low to reach the current limit threshold. Shifting this frequency up or down shifts all other operating frequencies in the same direction. In such a case, JP1 can be cut and removed. This will connect resistor 53 in series with resistor 55 and decrease all operating frequencies slightly. The running lamp power, ignition voltage and ignition current will also increase. All of these parameters should be carefully tested during production.

Component Values

For a 40 W/T12 fluorescent lamp, the preferred values of the circuit components shown in the diagram of FIGS. 3A and 3B are as follows:

| | |
|---|---|
| Inductor 66, 70 = 2.5 mh | |
| Capacitor 50 = 0.1 μF | Capacitor 74 = 4.7 μF |
| Capacitor 54 = 1 nF | Capacitor 80 = 0.1 μF |
| Capacitor 64 = 2.2 μF | Capacitor 106 = 1 nF |
| Capacitor 68, 72 = 15 nF | Capacitor 122 = 0.1 μF |
| Resistor 53 = 2 KΩ | Resistor 104 = 1 Ω |
| Resistor 55 = 27 KΩ | Resistor 105 = 56 KΩ |
| Resistor 56 = 470 KΩ | Resistor 112 = 330 KΩ |
| Resistor 58 = 470 KΩ | Resistor 114 = 330 KΩ |
| Resistor 60 = 91 KΩ | Resistor 116 = 330 KΩ |
| Resistor 62 = 680 KΩ | Resistor 118 = 100 KΩ |
| Resistor 75 = 1 MΩ | Resistor 124 = 330 KΩ |
| Resistor 101 = 470K | Resistor 125 = 330 KΩ |
| Resistor 102 = 100 KΩ | Resistor 126 = 330 KΩ |
| Resistor 103 = 150K | Resistor 127 = 100 KΩ |
| Resistors 132, 134, 136, 138, 140, 142 = 3 Ω | |

For a different fluorescent lamp, the preferred values of the inductor(s) and capacitor(s) of the resonant circuit will change, and the preferred values of the components in the electronic ballast will change accordingly.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circuit for driving first and second MOS gated power transistors which are connected in a half bridge arrangement for supplying an oscillating current to power a fluorescent lamp, the circuit including frequency sweep circuitry for generating an offset voltage which varies automatically in accordance with varying operating modes of the lamp, the offset voltage being added to a voltage input to a ballast controller integrated circuit for driving the power transistors, resulting in a corresponding change in the frequency output of the ballast controller integrated circuit, such that the lamp power is correspondingly varied in accordance with the operating modes.

2. A circuit as recited in claim 1, further comprising circuitry for detecting a fault condition and shutting down the ballast controller integrated circuit upon the occurrence of the fault condition.

3. A circuit as recited in claim 2, further comprising circuitry for automatically resetting the sweep circuitry upon the occurrence of the fault condition, such that the sweep circuitry automatically restarts upon correction of the fault condition.

4. A circuit as recited in claim 1, wherein the varying operating modes comprise lamp preheat, ignition, and running.

5. A circuit as recited in claim 2, wherein the fault condition comprises a broken cathode of the lamp.

6. A circuit as recited in claim 2, wherein the fault condition comprises a removal of the lamp.

7. A circuit as recited in claim 2, wherein the fault condition comprises a non-strike condition of the lamp.

8. A circuit as recited in claim 7, wherein the circuit for detecting a fault condition comprises sensing circuitry for converting a MOSFET source current into a voltage, and rectifying and integrating the voltage to produce a voltage corresponding to the degree of non-zero voltage switching of the MOSFET bridge due to a fault condition.

9. A circuit as recited in claim 1, further comprising circuitry for detecting an undervoltage condition of the line voltage and shifting the frequency back up to the start frequency.

10. A circuit for driving first and second MOS gated power transistors which are connected in a half bridge arrangement for supplying an oscillating current to power a fluorescent lamp, the circuit including sensing circuitry for converting a MOSFET source current into a voltage, and rectifying and integrating the voltage to produce a voltage corresponding to the degree of non-zero voltage switching of the MOSFET bridge due to a fault condition.

11. A circuit as recited in claim 10, further comprising blanking circuitry to delay enablement of the sensing circuitry during lamp start-up so as to prevent detection of non-zero switching during start-up.

* * * * *